United States Patent [19]

Flanner

[11] Patent Number: 4,920,996

[45] Date of Patent: May 1, 1990

[54] PROCESS FOR CLEANING FUEL INJECTORS

[76] Inventor: Lloyd T. Flanner, 135 Atterbury Dr., Hudson, Ohio 44236

[21] Appl. No.: 182,350

[22] Filed: Apr. 18, 1988

[51] Int. Cl.[5] ..... B08B 5/00

[52] U.S. Cl. ..... 134/22.11; 134/22.12; 134/22.14; 134/24; 134/36

[58] Field of Search ..... 134/36, 22.11, 24, 22.12, 134/22.14; 252/90, 305

[56] References Cited

U.S. PATENT DOCUMENTS

| | | | |
|---|---|---|---|
| 2,686,160 | 8/1954 | Kell et al. | 252/305 |
| 2,842,465 | 7/1958 | Harrison | 134/7 |
| 3,174,659 | 3/1965 | Sorber et al. | 252/305 |
| 3,194,449 | 7/1965 | Kaiser | 252/305 |
| 3,364,068 | 1/1968 | Stern | 134/36 |
| 3,387,425 | 6/1968 | Finner | 252/305 |
| 4,261,700 | 4/1981 | Monick | 252/305 |

*Primary Examiner*—Asok Pal

*Attorney, Agent, or Firm*—Oldham & Oldham Co.

[57] ABSTRACT

A method for cleaning engine fuel injectors which includes connecting the injectors to a canister containing an aerosol formulation comprising a liquid cleaner and a compressed air propellant, and thereafter forcing the cleaner through the injectors to remove contaminating deposits therefrom. The compressed air serves both as a combustion oxidant, as well as the propellant for the cleaner. In addition to including a material capable of dissolving injector contaminants, the cleaner may include as components thereof detergents, dispersants, detergent and dispersant solvents, lubricants, and other substances useful in cleaning processes.

3 Claims, 2 Drawing Sheets

PROCESS FOR CLEANING FUEL INJECTORS

TECHNICAL FIELD

This invention relates to fuel injectors for internal combustion engines. More particularly, this invention relates to cleaning fuel injectors for internal combustion engines by removing carbonateous materials, including gums, varnishes, tars, carbon deposits and the like therefrom by passing cleaning compositions through the injectors. Specifically, this invention relates to combustible cleaning composition mixtures packaged in aerosol canisters, adapted for connection to the fuel injectors through intermediate engine structure such as, for instance, fuel intake manifolds, or engine "rails", thereby permitting the introduction of such cleaning compositions to, and through the injectors connected to the rails, cleaning the injectors in the process. More specifically, this invention relates to combustible cleaning composition mixtures packaged in aerosol canisters which use compressed air as a propellant.

BACKGROUND OF THE INVENTION

Carburetors have long been used to mix fuel and air for subsequent combustion in internal combustion engines. A chief advantage of such devices has been that they are, relatively speaking, uncomplicated, which allows them to be maintained and repaired without undue difficulty. In the recent past, however, a great many environmental regulations and laws have been enacted governing permissible exhaust and similar emissions from engines, particularly from automobile engines. This has necessitated the addition of extensive antipollution devices and controls, making engine systems, including their carburetion, extremely complicated, much more expensive, and very difficult to maintain and repair.

Even under normal conditions, an automobile engine is required to respond to a variety of demands, for example, operation under both cold and hot conditions; a need to accelerate rapidly, requiring rich fuel mixtures, and then to operate at less strenuous cruising speed conditions, permitting the use of leaner fuel mixtures, as well as almost infinite, constantly changing performance requirements between such extremes. Irrespective of the demands made on the engine, however, the engine system, including particularly the fuel system, must be capable of furnishing an extremely precise fuel mixture to the engine in order to meet the regulatory requirements and the combusion requirements imposed upon it.

In view of such needs, it has been recognized for some time that controlled fuel injection, particularly that of the electronic type, offers the best hope for meeting the often conflicting demands of fuel economy, high engine performance, and allowable emissions. Fuel injectors, on which electronically controlled fuel injection systems rely, consist of three basic parts, i.e., an electromagnet, a needle valve, and a nozzle. The electromagnet is activated, for example, by a signal from an electronic control unit which moves the injector's needle valve sufficiently away from the opening in the nozzle to allow the inject or to deliver fuel in the form of a fine, atomized spray. The exact fuel required for any given operating condition can thus be introduced, based on information obtained from data delivered to the control unit from sensors located at multiple points throughout the engine and exhaust systems. The result is an extremely efficient method for controlling engine performance.

For the reasons described, fuel injector systems are the technology of choice for furnishing fuel to engines, and it is presently expected that virtually all domestically built automobile engines will be of the fuel injected type in the near future; with many of the injectors being of a type relying on some form of electronic injector control.

Notwithstanding their superior performance, however, fuel injectors are not without attendant problems. For example, they tend to accumulate unwanted deposits in the nozzle area, resulting in nozzle clogging which causes rough idling, as well as hesitation of the engine during acceleration. In this regard, injector nozzles are manufactured to extremely fine tolerances, and even microscopic foreign particles tend to result in their malfunction. Poor fuel quality, as well as ordinary operating conditions tend to be responsible for the unwanted accumulations of varnishes and other contaminants of the type described. These must be removed periodically if continued optimum performance of the injectors, and therefore of the engine is to be achieved.

DISCLOSURE OF THE INVENTION

In view of the foregoing, it is a first aspect of this invention to provide a method of removing contaminating deposits from fuel injectors.

A second aspect of this invention is to provide a fuel injector cleaning composition which is itself a highly combustible mixture, thereby permitting its application to and through the fuel injectors in a running engine, without interfering with engine operation during the cleaning process.

It is a further aspect of the invention to provide a cleaning composition for engine fuel injectors in an aerosol dispenser.

An additional aspect of this invention is to provide an aerosol dispenser which dispenses a fuel injector cleaning composition which uses compressed air as the propellant.

Another aspect of the invention is to furnish a system for cleaning the fuel injectors of a running automobile engine without simultaneously causing inferior running performance, which by itself could cause the accumulation of unwanted deposits on the engine fuel injectors, thus contributing to subsequent even poorer performance.

The preceding and additional aspects of the invention are provided by a canister containing an aerosol formulation comprising a liquid cleaner, and compressed air, said air having an initial pressure of from about 60 to about 110 pounds per square inch, gauge, measured at 70° F., and said liquid cleaner being present in an amount such that it occupies from about 25% to about 90%, on a volume basis, of the volume of said canister.

The preceding and still further aspects of the invention are provided by a process for cleaning the fuel injectors of an internal combustion engine comprising connecting said injectors to a canister according to the preceding paragraph, and passing said aerosol formulation through said injectors while the engine is running.

DESCRIPTION OF THE DRAWINGS

The invention will be better understood when reference is had to the following drawings, in which like numbers refer to like parts, and in which.

DETAILED DESCRIPTION OF THE INVENTION

Figure 1:
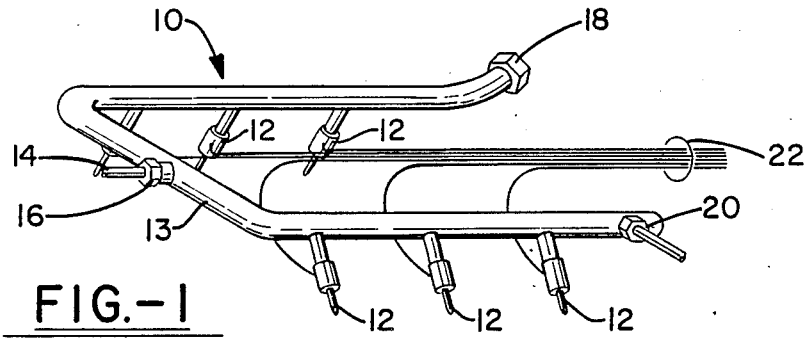
FIG. 1 is a representation of a number of fuel injectors connected to an engine rail assembly.

FIG. 1 illustrates a rail assembly, generally 10, showing a number of fuel injectors 12 connected to a manifold, or engine "rail" 13. Fuel enters the assembly through a fuel pipe feed line 14 connected to a fuel pressure regulator 16 attached to the rail. Excess fuel returns to the fuel tank from the rail 13 at return point 18. A fuel pressure tap 20 is commonly provided in rail 13 as a convenient point for measuring the pressure in the rail; the tap can also be used as a convenient entry point for introduction of a cleaning composition in a process later described. The fuel injectors 12 illustrated are of a type controlled by electric signals received through wiring harness 22 attached to the injectors 12.

By introducing the aerosol cleaner of the invention to the rail 13, each of the injectors is simultaneously exposed to the cleaner, tending to assure uniform cleaning of each of them during the cleaning process. While the Figure shows a multi-port electronic fuel injection system operating through a fuel distribution tube or manifold, commonly known as a fuel rail, the invention is also applicable to other systems of fuel injection, for example, that of the "throttle body" injection type, where one or two centrally located injectors are employed, typically in the position ordinarily reserved for the carburetor. In addition, the cleaning process is equally suitable for use with injectors employed in internal combustion engines depending on spark plugs for ignition of the fuel mixture, as well as engines of the diesel type, where compression of the fuel mixture is relied upon for its ignition.

Figure 2:
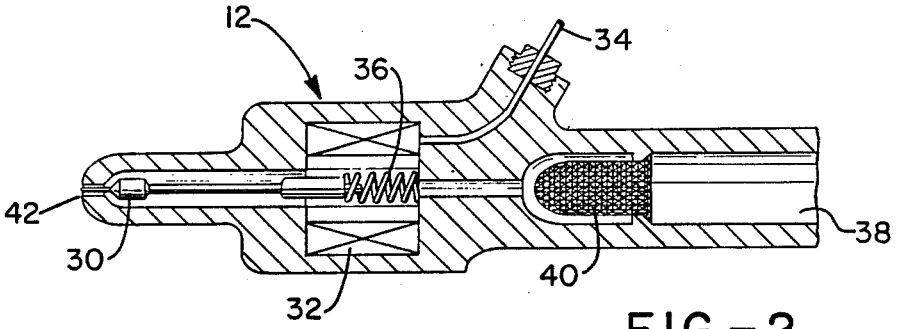
FIG. 2 is a semi-schematic, cross sectional illustration of a fuel injector.

FIG. 2 is a semi-schematic, cross sectional illustration of an electronically controlled fuel injector, generally 12, conceptually illustrating such details as the needle valve 30 which is moved away from nozzle 42 by magnetic coil 32, so as to allow fuel to be dispensed from the injector, the operative signal to the coil being supplied through electrical terminal 34. The needle valve 30 is returned to a blocking position, in the absence of an activating electrical signal, by return spring 38. Fuel enters the injector through fuel duct 38 and is typically filtered through the fuel filter 40 before being supplied to the nozzle. While the injector thus illustrated is of the electronically controlled type, other injectors which can also be cleaned by means of the invention include those forced open by high pressure fuel delivery systems, mechanical means, or various combinations of the preceding.

Figure 3:
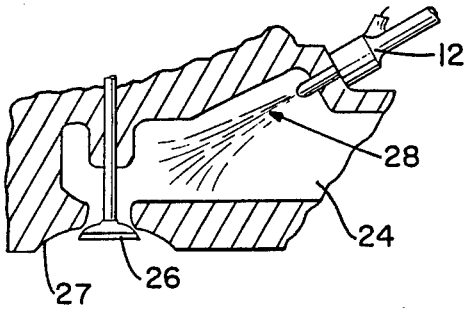
FIG. 3 is a partial, cross sectional representation of a fuel injector introducing a fuel spray into an engine intake manifold.

FIG. 3 is a partial cross sectional representation of a fuel injector introducing a fuel spray into an engine intake manifold.

As shown, an injector 12 is injecting a fuel spray 28 into an intake manifold 24 from which the fuel has access to a cylinder when intake valve 26 is in an open position. As is apparent from the Figure, the proximity of the tip of the nozzle of injector 12 to the cylinder 27 assures its exposure to high temperature conditions. Therefore, in addition to contaminants arriving by way of the fuel fed to the injector, the ambient heat surrounding the injector guarantees the formation of interfering varnishes, carbon particles and the like. Such contaminants interfere with the spray pattern 28, and thus cause poor performance of the engine.

Figure 4:
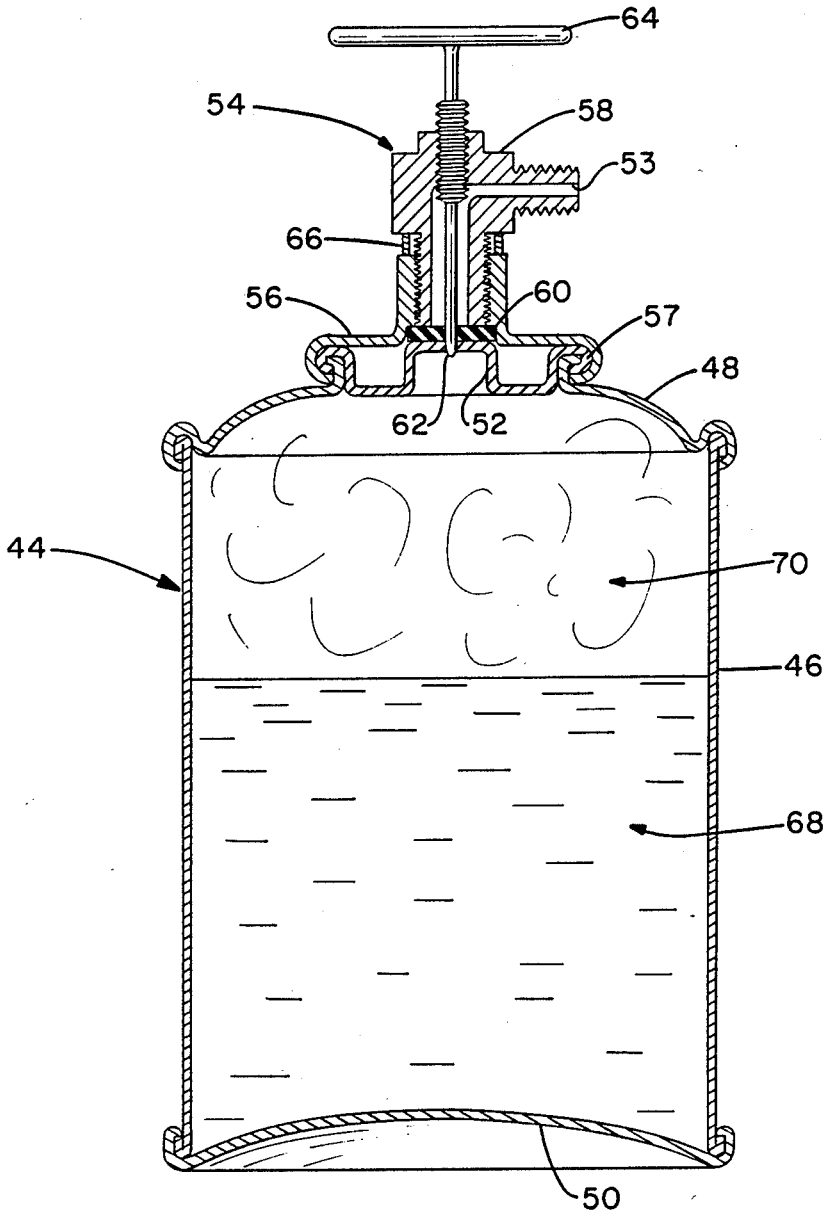
FIG. 4 is a cross section of an aerosol canister of the invention connected to a tap valve assembly.

FIG. 4 is a cross section of an aerosol canister of the invention, generally 44, connected to a tap valve assembly, shown generally as 54.

The canister 44 includes a cylinder portion 46, a top 48, and a bottom 50. The opening in the top 48, is closed by a valve cup 52 crimped thereto. The canister 44 is filled with the liquid cleaner 68 and pressurized air 70.

The contents of the canister are released by means of the tap valve assembly 54 which includes a collar portion 56 adapted to sealingly fit about lip 57 by means not shown. When the collar is in place, a threaded body portion 58 of the tap valve assembly 54 is threaded into the top of the collar portion until a spacer 66 prevents further engagement of the threaded portion with the collar. Thereafter, tap handle 64 which is threadably engaged with the body 58, may be screwed downward causing tap point 62 to penetrate the valve cup 52 allowing contents of the canister in its inverted operating position, to escape through duct 53, leakage between the collar 56 and cup 52 being prevented by the sealing contact of such components with gasket 60. Other "tap" structures may of course be employed, such as internally threaded tap valves that can be threadably attached to the valve cup 52, and which do not require a collar 56.

In the past fuel injector cleaning systems have relied upon forcing various cleaning solutions through injectors by attachment of the injectors to conventional aerosol cans, as well as to those of the barrier pack, or "Lechner" type. In the case of the convention aerosols, resort has been had to a variety of propellants including hydrocarbons such as propane, normal butane, isobutane, mixtures of them, and similar materials. Nitrogen and carbon dioxide have also been used. Unfortunately, however, when a hydrocarbon propellant is employed, the cleaning mixture passing through the injectors and being fed into the engine's cylinders contains such a concentrated amount of combustible hydrocarbons that modern engines are unable to adjust to accommodate the abnormally hydrocarbon rich mixture. The result is extremely rough operation and eventual stoppage of the engine. The period during which cleaning can be achieved is, therefore, not only disadvantageously shortened, but the poor combustion which occurs during the cleaning process, itself, contributes to further fouling of the injectors, as well as being otherwise harmful to the engine. Even in the case of the barrier pack canisters where the propellant is not free to enter the engine but simply acts to "squeeze" the cleaner compositions in a collapsible inner 37 pouch" contained within the canister thus forcing contents of the pouch out of the canister and through the injector, the concentrated hydrocarbons in the cleaner result in less than perfect combustion.

In the case of cleaner propellant systems which rely upon carbon dioxide or nitrogen, such materials actually act to suppress combustion within the cylinders, an effect which also contributes to rough operation and stalling, with the results previously noted.

Up to the present time, the aerosol industry has tended to rely on the propellants described, as well as others of a similar nature, rather than air. One reason that the use of air has been avoided is because of the propensity of the oxygen present to react with alcohols, preservatives, resins, and many of the other materials commonly dispensed in aerosol formulations. Such reactions result in discoloration of the cannister's contents, destroying the appearance of the materials discharged; they promote acid formation, resulting in corrosion of the canister, and cause other undesirable effects, all of which make the use of air undesirable.

Furthermore, the space within the aerosol container required for the gaseous propellant phase is to a large extent dependant upon the degree to which the gas dissolves in the liquid present As the aerosol container is emptied, additional gas must be provided to replace that expelled with the liquid contents discharged, and to fill the volume of space previously occupied by the liquid. Aerosol containers depend upon gas dissolved in the liquid contents of the system to be released from solution to the extent required to occupy the additional space thus created. Consequently, the suitability of a particular gas as a propellant depends upon the degree to which it is soluble in the liquid present in the system. Such solubility is expressed as the Ostwald solubility coefficient, which is simply a measure of the volume of the propellant gas that can be dissolved in a particular volume of the liquid at a given temperature and pressure. The higher the coefficient, the greater the amount of gas absorbed, and thus the greater the suitability of the gas as a propellant. Due to its undesirably low Ostwald coefficient in hydrocarbons, until the present invention, air has been considered as undesirable for use as a propellant with hydrocarbons.

Notwithstanding the preceding characteristics which have made compressed air unsuitable for use in aerosol systems, and which explain why compressed air is not employed for such purpose, it has unexpectedly been found that notwithstanding the criteria which the aerosol industry has heretofore used for judging the suitability of propellants, and in sharp contrast to propellant characteristics that the industry has previously required, compressed air not only can function as a suitable propellant for forcing liquid cleaners through fuel injectors from an aerosol container, but it also greatly enhances operation of the engine by furnishing supplementary oxidant material in the form of the oxygen present in the air.

As will be detailed more particularly in the following, the use of compressed air as a propellant for fuel injector cleaners results in an engine which runs smoothly throughout the cleaning process; it completely prevents premature engine stalling, and therefore, allows substantially the entire amount of cleaner in the container to be forced through the injectors, resulting in their superior cleaning. The result was all the more surprising in view of the limited solubility of air in the cleaner, from which it might have been expected that the oxygen contained in the liquid leaving the container would not significantly affect combustion of the fuel. Nevertheless, the beneficial affect on engine performance when compressed air is used as a propellant is dramatic, possibly because of the extremely homogeneous nature of the mixture of air leaving solution with the atomized droplets of the essentially combustible cleaner, an intimate mixture which results in greatly superior combustion.

The relative amounts of air and liquid present will depend upon a balancing of considerations including safety factors, the duration of cleaning required, and similar factors. While such ratios can be varied within a considerable range, it has been found desirable to have a volume of liquid in the aerosol canister equal to about 25% to 90%, on a volume basis, of the total space available. A volume of about 50% to 60%, however, is preferred, the balance of the space, commonly termed the "head space", being filled with the compressed air propellant.

Various liquid cleaners are suitable for cleaning fuel injectors; commonly however, they will include in addition to materials suitable for dissolving organic contaminants, dispersants, detergents, dispersant and detergent solvents, lubricants, mixtures of the preceding, and optionally other materials useful in cleaning processes.

The contaminant dissolver may be selected from aliphatic or cyclic compounds, combinations thereof, as well as their substituted derivatives, and mixtures of the preceding, the use of materials which include aromatic compounds being particularly useful for the purpose. Among such suitable compounds may be mentioned toluene, xylene, gasoline, heptane, hexane, and others. Suitable dispersants can be any of those well known to the art, including mixtures thereof, diazoline being an example of one such dispersant. Any of commonly available detergents, and mixtures thereof, including materials such as succinimide may be incorporated in the cleaner.

The nature of the dispersant/detergent solvent will depend upon the nature of, and the amounts of the materials to be dissolved, suitable solvents being well known to those skilled in the art.

The amounts of the components making up the liquid fuel injector cleaner may also be varied within fairly broad limits; normally, however, each of the dispersant and detergent materials will be present in an amount of from about 1 to 7%, by weight, of the total liquid present, with the solvent required for their solution constituting about 15% to 30%, by weight, of the total cleaner in the canister. The balance of the liquid cleaner present will be made up of the contaminant dissolver.

Figure 5:
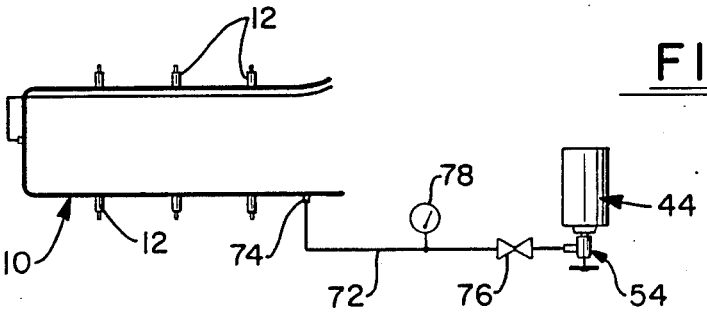
FIG. 5 is a schematic representation of an aerosol canister of the invention connected to a rail assembly during the fuel injector cleaning process.

FIG. 5 is a schematic representation of an aerosol canister of the invention connected to a rail assembly for the fuel injector cleaning process.

The Figure shows the fuel injectors 12 connected to a rail assembly 10 by a connector fitting 74. The fitting 74 is conveniently attached to a hydrocarbon-resistant pressure hose, or conduit, 72 equipped with a pressure gauge 78, and a valve 76 for regulating the pressure available to the system from the aerosol can 44 through the tap valve assembly 54. The nature of the components recited, and their method of attachment to each other, can be achieved through any of the means commonly available for the purpose.

The cleaning process is implemented by temporarily blocking the flow of fuel from the vehicle's fuel tank to the rail assembly, as well as the flow of fuel from the rail back to the fuel tank. The aerosol can 41 is thereafter connected in an inverted position to the rail, and the pressure in the rail is adjusted to that recommended by the vehicle's manufacturer, generally 15 to 70 pounds per square inch, gauge. The engine is then started and run until a sufficient amount of the cleaner has been passed through the injectors, commonly from about 8 to 20 fluid ounces, to thoroughly clean the injectors. The cleaning process normally requires in the neighborhood of about 5 to 30 minutes, depending upon the degree of contamination of the injectors. The cleaning assembly is thereafter disconnected, and the engine restored to its initial pre-cleaning configuration.

While a canister having a capacity of about 20 fluid ounces has been found to contain sufficient cleaner for cleaning most engine fuel injectors, the volume of a canister may readily be varied from about 8 to 32 fluid ounces. The cannister will be pressurized with air to from about 25 to 110 pounds per square inch gauge, at 70° F., with a pressure of about 100 pounds per square inch gauge normally providing the best results. The amount of compressed air present will be from about 0.15% to 1.25% on a weight basis, based on the entire weight of the cannister's contents, including the liquid cleaner present.

In a comparison test, a variety of automobile engines were cleaned to compare the composition and method of the invention, relative to a variety of competetive aerosol cleaner systems, with results obtained as follows:

| AUTOMOBILE | ENGINE SPEED (Approx. RPM) | SYSTEM #1 RUNNING TIME- (Minutes) | SYSTEM #2 RUNNING TIME (Minutes) | SYSTEM #3 RUNNING TIME (Minutes) | SYSTEM #4 RUNNING TIME (Minutes) |
|---|---|---|---|---|---|
| Pontiac, Bonneville, V6-3.1 liter, Port-rail engine | 900 | 12 | 8 | 6.5 | 13 |
| Lincoln Town Car, V8, 5.0 liter, Port-rail engine | 1000 | 10 | 7 | 5 | 11 |
| Pontiac Sunbird, 4 cylinder, 1.8 liter, throttle body engine | 800 | 25 | Insufficient pressure | Engine stalling | 25 |
| Chrysler Lancer, 4 cylinder, Throttle body engine | 800 | 11.6 | Engine Un- | Engine | 10.5 |

-continued

| startable | stalling | |
|---|---|---|
| | SYSTEM DESCRIPTION | |
| System 1 - Barrier Type Lechner Can, 14.5 liquid ounces | System 2 - Standard Aerosol Can, Carbon Dioxide Propellant, 11 fluid ounces | System 3 - Standard Aerosol Can, Propane Propellant, 15 fluid ounces |
| System 4 - Standard Aerosol Can, Compressed Air Propellant, 11 fluid ounces | | |

From the results off the comparative tests described above, it is clear that System 4, involving compressed air as the propellant showed significantly longer running times in every case than did cleaning systems using other propellants of the type known to the prior art.

Aerosol cans using the compressed air of the invention as a propellant can be prepared by any of well known ways for producing aerosol cleaning systems, e.g., filling the can with the desired amount of liquid cleaner, and then pressurizing it, preferably by an under-the-cap method, although regular gasser, or shaker-gasser methods may also be used.

While in accordance with the patent statutes, a preferred embodiment and best mode has been presented, the scope of the invention is not limited thereto, but rather is measured by the scope of the attached claims.

What is claimed is:

1. A process for cleaning the fuel injectors of an internal combustion engine comprising connecting said injectors to a canister containing an aerosol formulation including a liquid cleaner, and compressed air, said air having an initial pressure from about 25 to about 110 pounds per square inch, gauge, measured at 70° F., and said liquid cleaner being present in an amount such that it occupies from about 25% to about 90%, on a volume basis, of the volume of said canister, and passing said aerosol formulation through said injectors while the engine is running.

2. A process according to claim 1 wherein said engine is a gasoline engine, and wherein said injectors and said canister are connected to the rail of the engine.

3. A process according to claim 1 wherein said liquid cleaner includes at least one member of each of the group comprising an aromatic hydrocarbon, a detergent, a dispersant, and a solvent for said detergent and said dispersant.

* * * * *